United States Patent [19]

Doherty

[11] Patent Number: 4,893,437

[45] Date of Patent: Jan. 16, 1990

[54] POWER SANDING ADAPTER FOR JIGSAWS

[76] Inventor: John P. Doherty, 49 Soley St., Charlestown, Mass. 02129

[21] Appl. No.: 178,555

[22] Filed: Apr. 7, 1988

Related U.S. Application Data

[63] Continuation-in-part of Ser. No. 158,571, Feb. 22, 1988, Pat. No. 4,790,045.

[51] Int. Cl.[4] ..... B24B 23/00

[52] U.S. Cl. ..... 51/170 TL; 15/22 R; 15/93 R

[58] Field of Search ..... 15/836.01, 93 R, 22 R; 30/272 A, 169; 229/37, 69; 173/170, 29; 51/170 TL, 175

[56] References Cited

U.S. PATENT DOCUMENTS

| | | | |
|---|---|---|---|
| 2,137,842 | 11/1938 | Jackson | 104/13 |
| 2,155,713 | 4/1939 | Jargick | 104/13 |
| 2,305,691 | 9/1957 | Medal | 144/1 |
| 2,589,138 | 3/1952 | Reno | 30/272 |
| 2,722,072 | 11/1955 | Aspeek | 41/1 |
| 2,874,946 | 2/1955 | Singleterry | 262/13 |
| 3,009,493 | 11/1961 | Dodegge et al. | 144/1 |
| 3,841,416 | 10/1974 | Pfister | 173/31 |
| 4,053,958 | 10/1977 | Taylor | 15/93 |
| 4,162,809 | 7/1979 | Anderson | 299/37 |
| 4,182,000 | 1/1980 | Fairbairn | 15/236 |
| 4,286,383 | 9/1981 | Farden | 30/169 |
| 4,317,282 | 3/1982 | Pace | 173/170 X |
| 4,330,938 | 5/1982 | Martin | 299/37 X |
| 4,363,577 | 12/1982 | Hartman | 408/20 |

*Primary Examiner*—Edward L. Roberts

*Attorney, Agent, or Firm*—Weingarten, Schurgin, Gagnebin & Hayes

[57] ABSTRACT

An adapter is disclosed for converting a portable jigsaw into a hand-held instrument for removing wallpaper. The adapter includes an extension clamped to the table of the jigsaw that both provides structural strength as well as a reciprocating blade mount. The extension is preferably formed of plastic. In an alternative embodiment, instead of the reciprocating blade, a sander is mounted to the reciprocating portion of the extension.

9 Claims, 7 Drawing Sheets

POWER SANDING ADAPTER FOR JIGSAWS

CROSS-REFERENCE TO RELATED APPLICATIONS

This invention is a continuation in part of copending U.S. patent application Ser. No. 158,571 filed Feb. 22, 1988, now U.S. Pat. No. 4,790,045.

FIELD OF THE INVENTION

This invention is directed to the field of scrapers, and more particularly, to a novel power adapter for wallpaper removal for jigsaws.

BACKGROUND OF THE INVENTION

In home and office remodeling, it is often necessary or desirable to remove existing wallpaper before applying another surface finish. The problem that presents itself is that the adhesives with which the wallpaper has been applied to the surface of the wall prevent its easy removal at the time of remodeling. Strenuous manual activity is expended in the use of a hand held scrapper in bringing it repeatedly against the wallpaper while the wallpaper is being removed. It is typically necessary to use the hand held scraper technique whenever the wallpaper to be removed has one or more coats of paint applied thereto, which prevents the use of chemical wallpaper removal fluids, and also for removing adhesive residues off of the exposed surfaces of the walls. The manual wallpaper removal technique is not only strenuous and thus tiresome but it also is time consuming. Various motorized devices such as the hand tool of U.S. Pat. No. 2,722,072 and the stripping tool of U.S. Pat. No. 2,589,138 that are specially designed and dedicated to wallpaper removal are known. The purchase of an entirely new instrument, is, however, often not warranted in view of the relative infrequency with which wallpaper is removed by most users. Various adapters are also known, such as those shown in U.S. Pat. No. 4,182,000 and U.S. Pat. No. 4,286,383 for oscillating-type power instruments. These devices, however, have been difficult to manipulate due to their cumbersomeness, and, among other disadvantages, have been generally incapable of accepting extenders so that their operation near the ceiling would undesirably require the use of a ladder or other such tool.

SUMMERY OF THE INVENTION

The present invention contemplates as its principal object a power wallpaper removal adapter for jigsaws. The novel adapter includes an elongated, hand claspable arm. The arm provides structure by means of which the power wallpaper removal instrument is manipulable as well as provides a mount to which a scrapping element is mounted for reciprocating movement A clamp is provided for securing the arm to the table of a jigsaw so that the arm stably extends therefrom in the direction generally parallel to the direction of elongation of the reciprocating chuck of the jigsaw. The scraper is fastened to an elongated post that is fastened to the reciprocating chuck of the jigsaw. As the jigsaw element reciprocates, the scraper mounted post also reciprocates, and thereby the scrapper element is moved back and forth reciprocally. A sanding element in an alternative embodiment is mounted for reciprocating motion to the elongated post fastened to the reciprocating chuck of the jigsaw. The sanding element comprises a plate which receives sandpaper sheets having a shaft mounted to its back surface via a universal coupling. In either embodiment, the adapter is manipulable by the arm to bring the reciprocating element adjacent the wallpaper to be removed, and is manipulable from floor to ceiling over the lateral expanse of the wall. The adapter is easy to use and manufacture, and the arm thereof is preferably injection molded from thermoplastic material. The clamp preferably is fashioned from metal. The adapter is desirably provided as a kit, which converts, for example, the home jigsaw into a power wallpaper removal instrument. The adapter is manufacturable at a comparatively low cost.

BRIEF DESCRIPTION OF THE DRAWINGS

Other objects, advantages, and aspects will become apparent as the invention becomes better understood by referring to the detailed description thereof and to the drawings, wherein.

DETAILED DESCRIPTION OF THE PREFERRED EMBODIMENT

Figure 1:
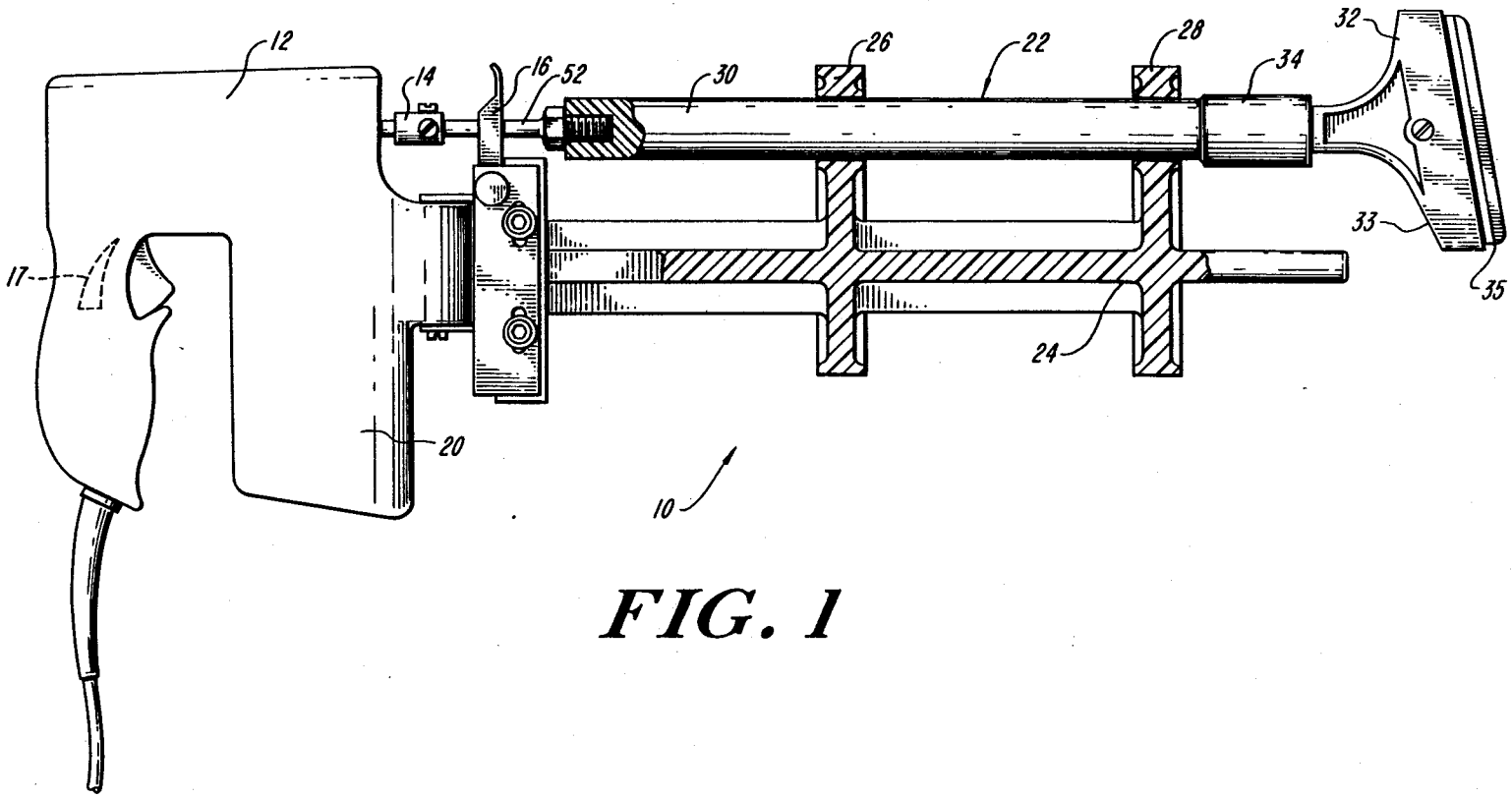
FIG. 1 is a partially sectional side elevation of the novel power wallpaper removal adapter for jigsaws according to the present invention.

Referring now to FIG. 1, generally designated at 10 is the power wallpaper removal adapter according to the present invention. A jigsaw 12 of conventional design and readily available in an off-the-shelf condition has a chuck 14 into which a saw element is mountable through the opening provided therefor of a support and guide table 16. As will be appreciated, the jigsaw is grasped by its handle portion and the table 16 thereof is positioned on the item to be sawed. The squeezing of the jigsaw trigger actuates the reciprocating motion of the jigsaw chuck 14, and therewith the blade mounted therein. As the saw is moved, the blade cuts through the element to be sawed. A stop illustrated dashed at 17 may be provided to limit the travel of the trigger.

The table 16 includes rip fence mounting openings well known to the skilled in the art, and the table is pivotally mounted to the jigsaw so that the handle and table may be angled to each other in a selected orientation. An adjustment screw 20 is provided for securing the handle and table at an intended orientation.

Any suitable off-the-shelf jigsaw may be employed.

In accordance with the present invention, an extension generally designated 22 is provided that is mounted to the table 16 of the jigsaw 12. The extension 22 is elongated in the direction of elongation of the movement axis of the chuck and extends generally parallel thereto. The extension 22 may be any suitable length that provides for ease of manipulation and that enables the removal of wallpaper at a desirable distance from the jigsaw such as for the regions of wall near the ceiling. In the preferred embodiment, the extension 22 is elongated by a factor of about 2 and ½ times the height of a standard jigsaw.

The extension 22 includes an arm 24 that provides structural rigidity to the extension 22 as well as hand graspable and manipulable surfaces that allows a user of the adapter to move and position the wallpaper removal tool. First and second spaced apart flanges 26, 28 are provided traverse the arm 24 that extend a distance sufficient to intersect the line of action of the chuck 14. The flanges 26, 28 include bearing races through which a post 30 is slidably mounted for reciprocating motion. A scraper 32 is mounted via a coupling 34 to be described to one end of the post 30, and the other end thereof is fastened to the chuck 14 in a manner to be described. The scraper has a removable blade 33, the ends 35 of which are preferably rounded. The extension 22 is preferably injection molded of a thermoplastic material, although any other suitable material that provides structural strength and bearing races can be employed as well without departing from the inventive concept.

Figure 2:
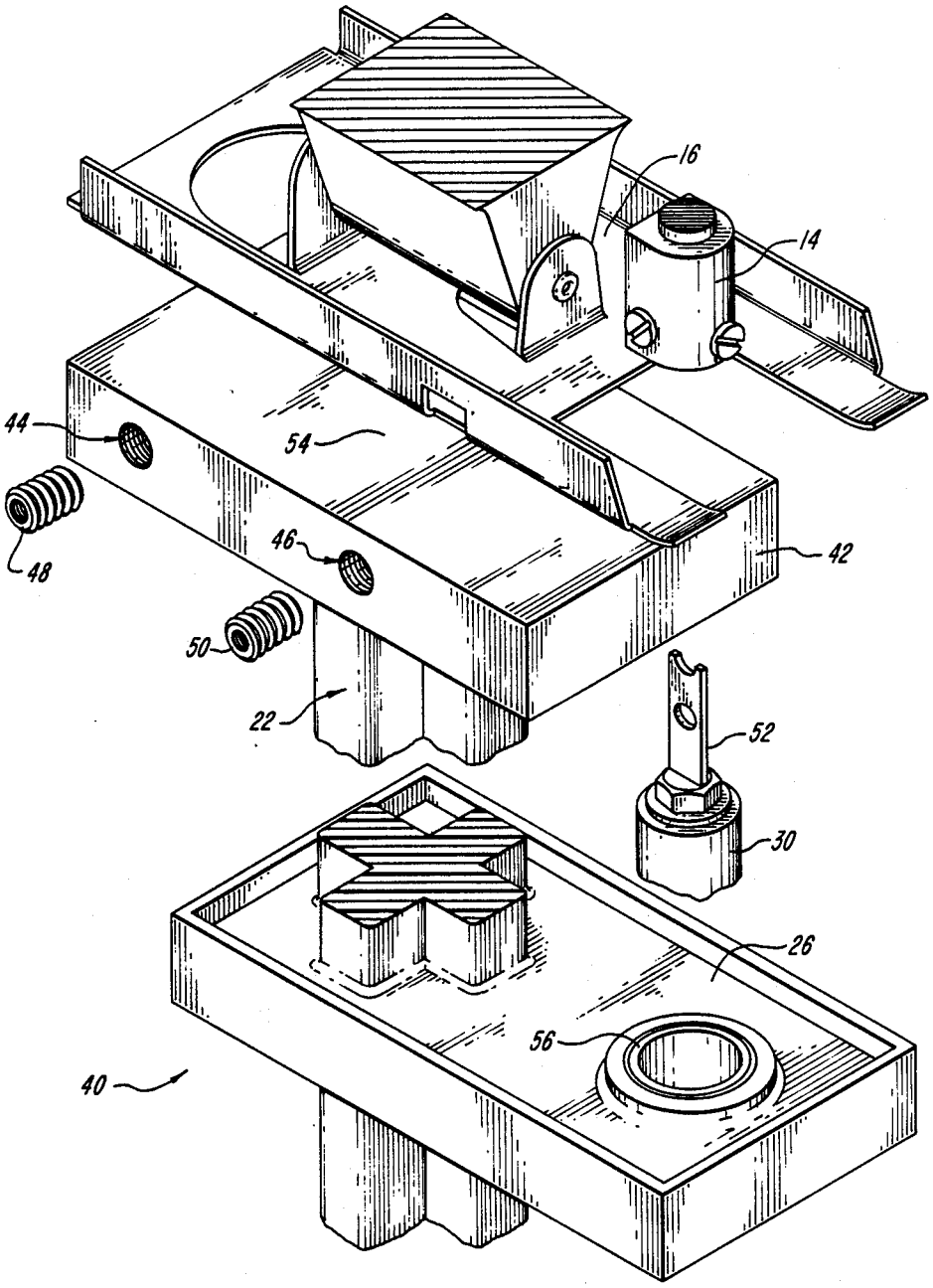
FIG. 2 is an exploded, isometric view illustrating the adapter-to-jigsaw interface.

Referring now to FIG. 2, generally designated at 40 is a partial exploded isometric view of the end of the extension 22 confronting the table 16 of the jigsaw. The extension 22 terminates in a foot 42 adapted for clamping to the table 16 of the jigsaw. The foot 42 preferably is in the form of a plate, the width of which corresponds to the width of the table 16, and the length of which extends for a portion of the length of the table 16 but terminates short of the line of action of the chuck 14 to allow the post 30 (FIG. 1) to be attached thereto. The foot 42 includes spaced-apart openings 44, 46 provided through a side wall thereof into which thread defining plugs 48, 50 are slidably inserted. The openings 44, 46 cooperate with a clamp to be described to removably stably attach the extension to the jigsaw.

As can be seen in FIGS. 1 and 2, an apertured mounting finger 52 is threadably fastened to the end of the post 30 confronting the chuck 14. The mounting finger 42 preferably is a metallic strip having spaced apertures therealong, which is threadably attached to the chuck 14 as by threaded fasteners 54. While a metallic finger that is threadably fastened into the post end is presently preferred, any other suitable chuck-to-post-end interface may be employed as well without departing from the inventive concept.

The flange 26 includes a race 56 thereinthrough that is concentric with the line of action of the chuck 14. The race 54 may include any suitable low friction material coated or otherwise provided for control of wear and friction. The flange 28 is similarly provided.

Figure 3:
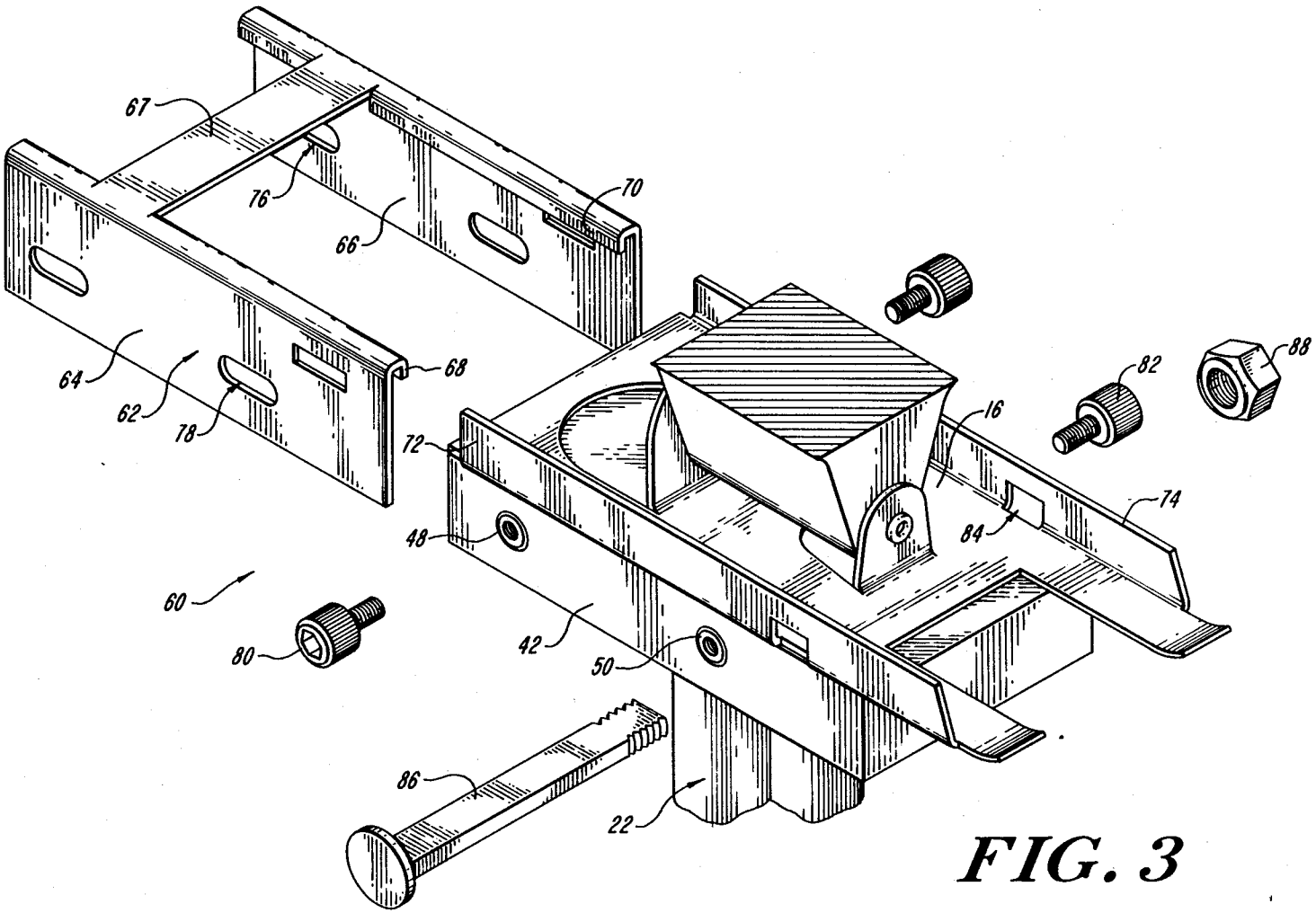
FIG. 3 is an exploded isometric view illustrating the clamp that stably attaches the adapter to the jigsaw table.

Referring now to FIG. 3, generally designated at 60 is a partial exploded isometric view illustrating the clamp assembly of the power wallpaper removal adapter for jigsaws according to the present invention. The clamp 60 includes a sleeve generally designated 62 having confronting spaced sidewalls 64, 66 dimensioned to straddle the outside of the table 16 and foot 42 of the extension 22. The sidewalls 62, 64 are interconnected by a web 66, that defines a positioning stop. The web 66 of the clamp 60 abuts the confronting wall of the table 16 when it is slid over the table 16 and foot 42.

Flanges 68, 70 are provided on inside confronting edges of the sidewalls of the clamp 60 that define channels into which the confronting edges of the flanges 72, 74 of the table 16 are seated. The flanges 68, 70 of the clamp 60 cooperate with the flanges 72, 74 of the table 16 to stabilize the extension 22 against lateral motion.

The sidewalls 64, 66 of the clamp 60 include confronting slots generally designated 76, 78. The slots 76, 78 receive the threaded shafts of fasteners 80, 82 in the corresponding thread plugs 48, 50 provided in the sidewalls of the foot 42 of the extension 22. As will be appreciated, the fasteners 80, 82 cooperate with the openings 76, 78 and threads 48, 50 to releasably secure the clamp 62 to the foot 42, and thereby secure the extension 22 to the table 16.

The table 16 includes confronting rip fence mounting apertures generally designated 84 provided through corresponding flanges 72, 74 thereof. As will be appreciated, the apertures 84 receive a so-called rip fence, the use of which enables the jigsaw to be positioned laterally of an edge to provide an intended cut path in a manner well known to those skilled in the art.

A threaded fastener 86 is slidably mounted through the confronting rip fence mounting apertures 84 to stablize the clamp 62 against sliding motion along the walls 72, 74 of the table 16. The fastener 86 preferably has a flattened rectangular shaft corresponding in size to the dimensions of the rip fence mounting apertures 84 that extends across the width of the table 16. The threaded free end thereof receives a nut 88.

Figure 4:
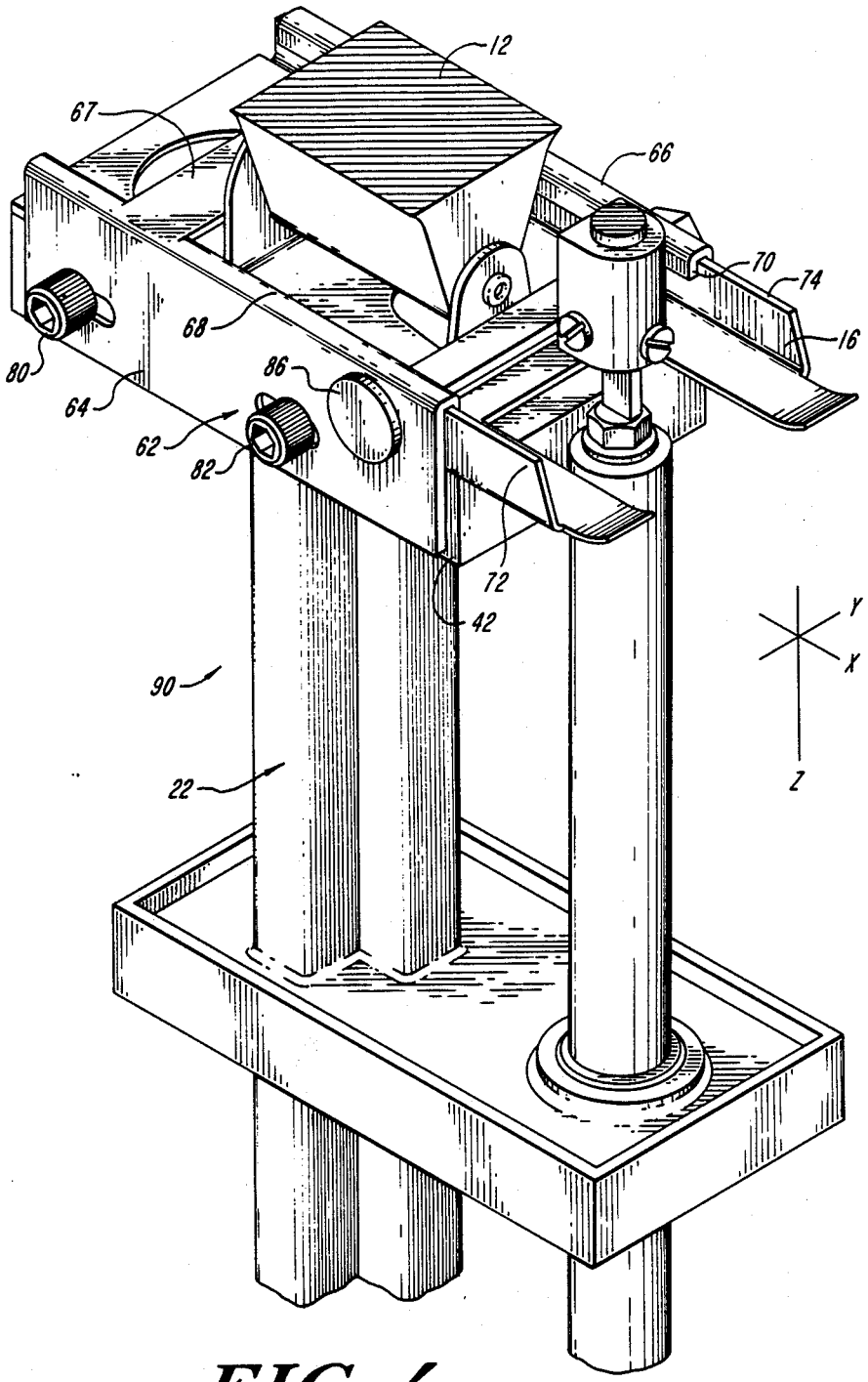
FIG. 4 is a partial isometric view illustrating the adapter attached to the table of the jigsaw and secured against motion by the clamp.

Referring now to FIG. 4, generally designated at 90 is a partial isometric view illustrating the extension 22 in assembled condition with the table 16 of the jigsaw 12. The flanges 68, 70 of the clamp 62 straddle the corresponding flanges 72, 74 of the table 16, which, together with the shafts of the threads 80, 82 received in the sidewalls of the foot 42 of the extension 22, are cooperative with the flanges to secure the foot 42 to the table 16 and prevent the motion of the extension 22 away from the table 16 in the Z direction. Further, the sidewalls 64, 66 and confronting sidewalls of the table 16 and foot 42 cooperate with the flanges 68, 70 of the clamp 62 to stabilize the extension 22 against lateral motion in the Y direction. The web 66 and the threaded member 86, that straddle the sides of the jigsaw 12, are cooperative to stabilize the extension 22 against movement in the X direction.

Figure 5:
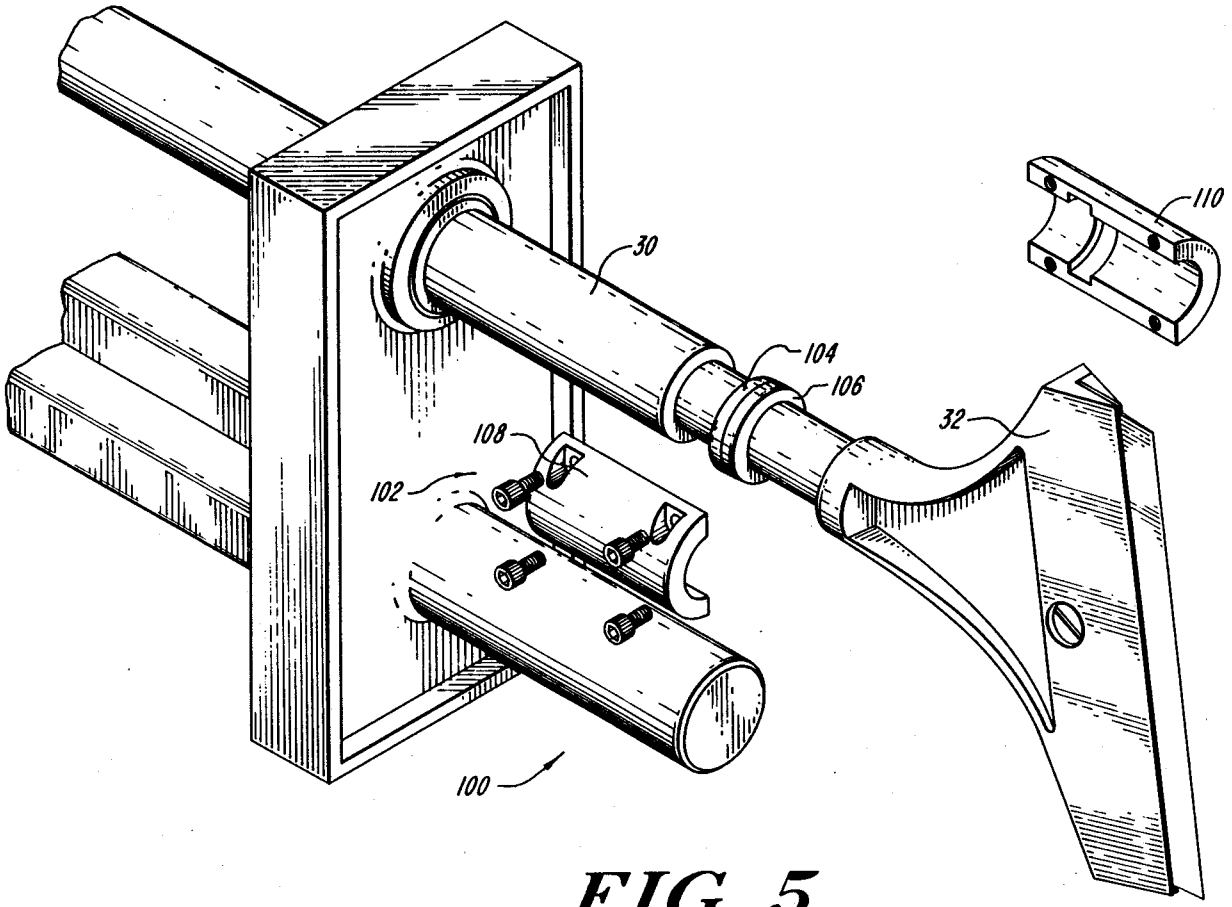
FIG. 5 is a partial, exploded isometric view illustrating the blade-to-post swivel mount.

Referring now to FIG. 5, generally designated at 100 is a partial, exploded isometric view illustrating the presently preferred blade-to-post attachment according to the present invention. A rotary joint generally designated 102 is provided to fasten the end of the post 30 remote from its chuck attachment end to the blade 32 while providing rotation of the blade with respect to the post. The rotary joint 102 includes cooperative collars 104, 106 respectively provided on the confronting ends of the post and blade around which a split sleeve 108, 110 is fastened together by any suitable means such as the threaded fasteners illustrated. The rotary joint 102 axially joins the blade 32 to the post 30 for reciprocating movement therewith while permitting rotary motion of the blade 32 relative to the post 30. In this way, the angle of the blade 32 may be selectively positioned with respect to the wall in such a way as to provide a self-aligning action; that is, the blade remains seated notwithstanding that the power wallpaper remover is moved about the wall and thus adopts various angles with respect thereto during its operation. Any other suitable coupling may of course be employed without departing from the inventive concept.

Figure 6:
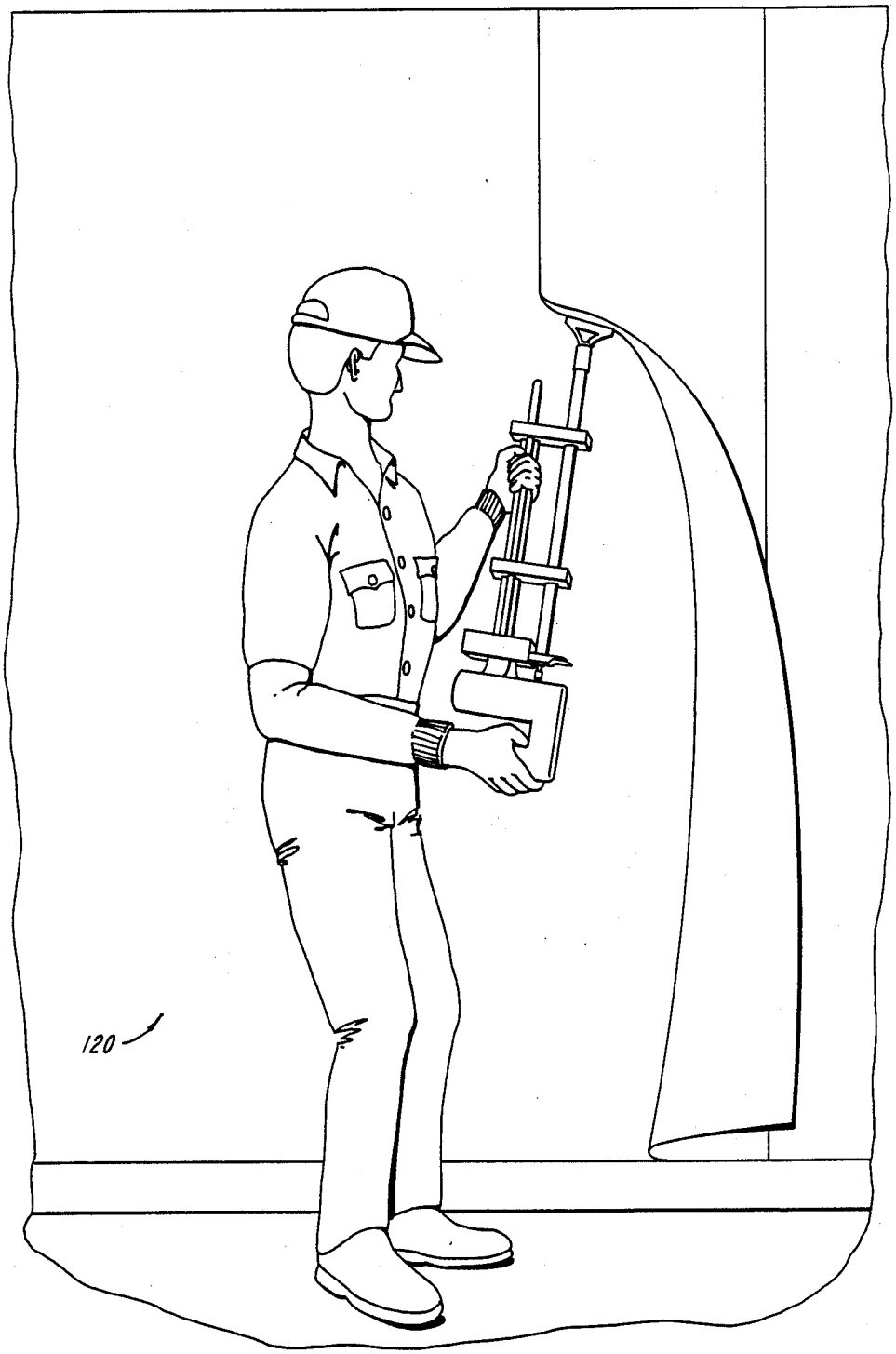
FIG. 6 is a pictorial diagram illustrating the present invention in use in removing wallpaper.

Referring now to FIG. 6, generally designated at 120 is a pictorial diagram useful in illustrating the use of the present invention. As shown, a user securely grasps a portion of the arm of the extension to stabilize the power wallpaper removal instrument with one hand, and grasps the handle of the jigsaw to which the adapter is clamped with the other hand. Using both hands, the user positions the instrument with the blade end thereof in engagement with the interface between the wall and the paper to be removed. The trigger of the jigsaw is depressed, and the resulting reciprocal movement imparted to the blade acts to tear the wallpaper off the wall. As the user jockies the instrument positionally about the wall, the blade pivots about its rotary joint and remains in wall contact notwithstanding any concomitant tilting and twisting movements of the power wallpaper removal instrument of the invention. After completing the task of removal, the jigsaw can be restored to operation as a jigsaw, simply by releasing the fasteners holding the clamp and post, and removing the extension therefrom. In the event of a future need, the jigsaw can once again be readily adapted to power wallpaper removal.

Figure 7:
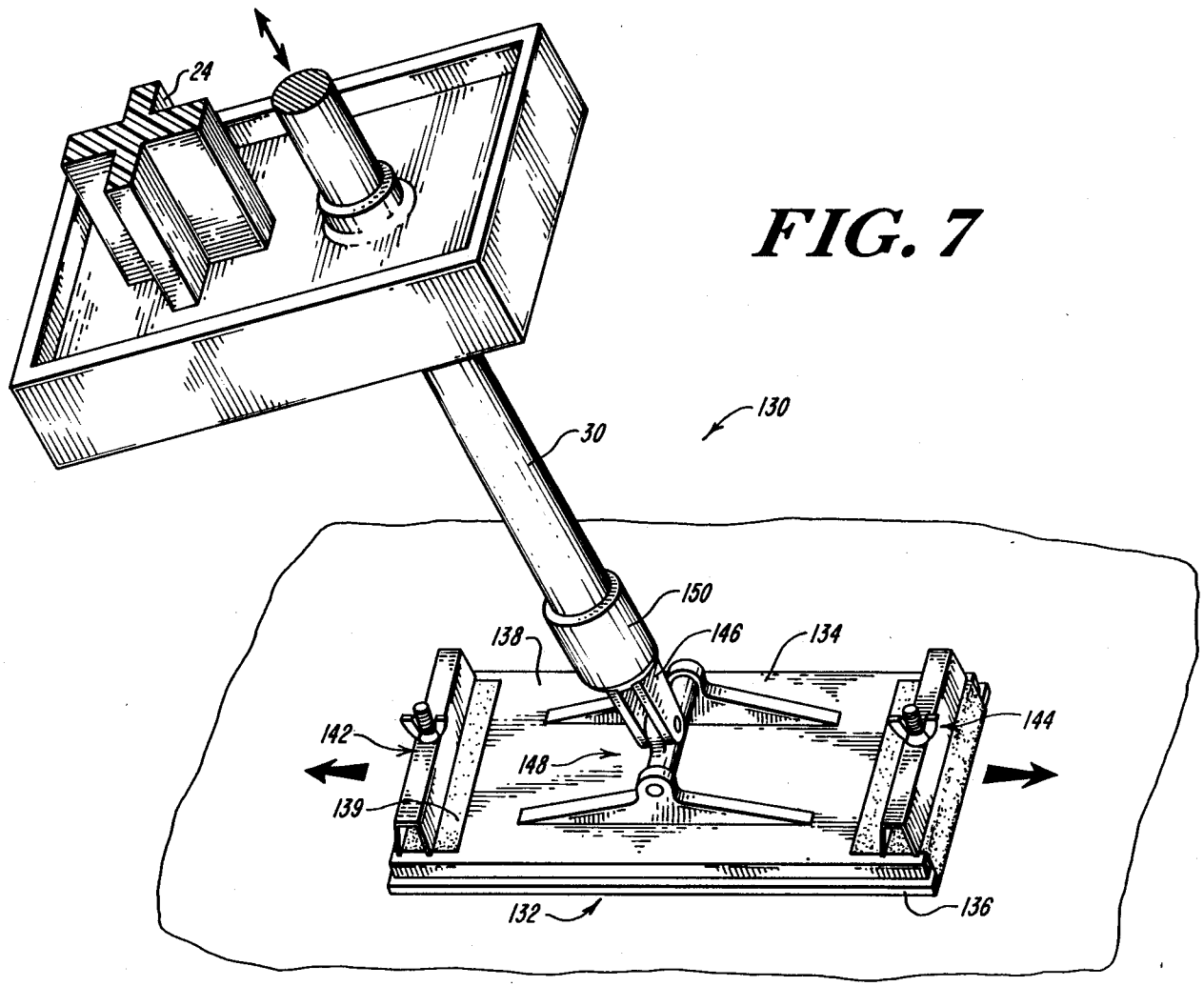
FIG. 7 is a partial, exploded isometric view illustrating a power adapter for sanding walls for jigsaws according to an alternative embodiment of the present invention.

Referring now to FIG. 7, generally designated at 130 is a partial, exploded isometric view illustrating the adapter of the present invention operative as a sanding element. The reciprocating movement of the jigsaw element is imparted through the elongated post 30 and to a sander attachment generally designated at 132. The sander attachment 132 includes a plate 134 having opposing surfaces 136, 138. A sheet of sandpaper 139 is wrapped around the surface 136 and removably fastened at the ends to the plate 136 by releasable threaded clamps generally designated at 140 and at 142.

A post 146 is fastened to the midpoint of the surface 138 via a universal coupling generally designated 148 so as to allow the free movement of the plate 134 angularly about the axis of the post shaft. In this way, the plate is able to be seated against a flat surface such as a wall being sanded irrespective of the angle that the adapter of the invention happens to make with respect to the wall being sanded. The sanding element is mounted to the elongated post 30 as by a coupling 150. The coupling 150 preferably includes mating complementary threaded portions.

Various different tools can be mounted to the elongated post 30 to enable the jigsaw adapter of the present invention to function as other than a scraping instrument or as a sanding instrument, as will be readily appreciated by those skilled in the art having benefit of the instant disclosure.

Other modifications of the presently disclosed adapter will be apparent to those skilled in the art having benefit of the instant disclosure without departing from the spirit of the invention.

What is claimed is:

1. A tool attachment for a jigsaw, comprising:

an extension having a foot;

means for clamping the foot to a jigsaw so that the extension is rigidly attached thereto without tilting off the axis of elongation thereof;

an elongated post having a tool attachment end and a remote end;

means for mounting the elongated post to the extension for reciprocating motion with respect to the extension; and means for fastening the remote end of the elongated post to a chuck of a jigsaw so that the post is moved reciprocally with the reciprocating motion of the chuck of the jigsaw.

2. The invention of claim 1, wherein said jigsaw includes a table having flanges and wherein said clamping means includes a sleeve having spaced, confronting sidewalls spaced apart the widthwise dimension of the table, and flanges defining U-shaped channels that receive the corresponding edges of the flanges of the table of the jigsaw.

3. The invention of claim 2, wherein said fastening means includes an apertured finger.

4. The invention of claim 1, further including a tool, and wherein the tool attachment end of the elongated post includes means for mounting the tool to the tool attachment end.

5. The invention of claim 4, wherein said tool is a sandpaper receiving plate.

6. The invention of claim 5, wherein said means for mounting said tool to the tool attachment end of said elongated post includes a threaded coupling.

7. The invention of claim 5, further including means for mounting the sandpaper receiving plate to the post so that it is axially attached thereto but free for rotary motion with respect thereto.

8. The invention of claim 7, wherein said sandpaper receiving plate mounting means includes a universal joint.

9. The invention of claim 8, wherein said sandpaper receiving plate includes means for retaining a sheet of sandpaper on the plate.

* * * * *